US009050714B2

(12) United States Patent
Gustafsson et al.

(10) Patent No.: US 9,050,714 B2
(45) Date of Patent: Jun. 9, 2015

(54) HAND-HELD DEMOLITION TOOL

(75) Inventors: Daniel Gustafsson, Kalmar (SE); Olof Östensson, Kalmar (SE); Per Gustafsson, Kalmar (SE)

(73) Assignee: Construction Tools PC AB, Kalmar (SE)

( * ) Notice: Subject to any disclaimer, the term of this patent is extended or adjusted under 35 U.S.C. 154(b) by 633 days.

(21) Appl. No.: 13/138,886

(22) PCT Filed: Jun. 1, 2010

(86) PCT No.: PCT/SE2010/050601

§ 371 (c)(1), (2), (4) Date: Oct. 17, 2011

(87) PCT Pub. No.: WO2010/151205

PCT Pub. Date: Dec. 29, 2010

(65) Prior Publication Data

US 2012/0055688 A1 Mar. 8, 2012

(30) Foreign Application Priority Data

Jun. 25, 2009 (SE) ..... 0900868
Jun. 25, 2009 (SE) ..... 0900869

(51) Int. Cl.

| | |
|---|---|
| ***B25D 17/24*** | (2006.01) |
| ***B28D 1/26*** | (2006.01) |
| *B25D 9/00* | (2006.01) |
| *B25D 9/02* | (2006.01) |

(52) U.S. Cl.

CPC . *B25D 17/24* (2013.01); *B25D 9/00* (2013.01); *B25D 9/02* (2013.01); *B25D 2250/291* (2013.01); *B28D 1/265* (2013.01)

(58) Field of Classification Search

CPC ..... B25D 17/24; B25D 17/043–17/046; B25D 17/04; B25D 17/32; B25D 17/18; B25D 9/00; B25D 9/04; B25D 2250/051; B25D 15/00; B28D 1/22; B28D 1/265; E01C 2301/50; E01C 23/0855

USPC ..... 173/162.2, 162.1, 122, 210, 213, 170, 173/80; 125/6; 175/213; 29/81.1; 299/69, 299/100, 37, 36.1

See application file for complete search history.

(56) References Cited

U.S. PATENT DOCUMENTS

| | | | | | |
|---|---|---|---|---|---|
| 1,476,120 | A | * | 12/1923 | Van Sickel | 125/41 |
| 1,484,944 | A | * | 2/1924 | Hansen | 404/133.1 |
| 1,634,298 | A | * | 7/1927 | Padbury | 125/41 |
| 1,893,355 | A | * | 1/1933 | Bicknell | 125/41 |
| 2,197,154 | A | * | 4/1940 | Miller | 299/37.4 |
| 2,748,750 | A | * | 6/1956 | Altschuler | 173/162.1 |

(Continued)

FOREIGN PATENT DOCUMENTS

| | | | | |
|---|---|---|---|---|
| AU | 555891 | * | 9/1982 | B28D 1/265 |
| CN | 202543780 U | * | 11/2012 | E04G 21/02 |

(Continued)

*Primary Examiner* — Hemant M Desai
*Assistant Examiner* — Eduardo R Ferrero
(74) *Attorney, Agent, or Firm* — Mark P. Stone

(57) ABSTRACT

The invention relates to a hand-held demolition tool (1) comprising a cylinder (2), a rear handle (6) and a flexible coupling (4) for the flexible connection of the cylinder (2) and the rear handle (6). According to the invention, the flexibility of the coupling (4) is arranged such that it allows flexibility only in the property pivot action between the cylinder (2) and the rear handle (6) around a rigid theoretical axis (9).

7 Claims, 4 Drawing Sheets

(56) References Cited

U.S. PATENT DOCUMENTS

Figure 1:
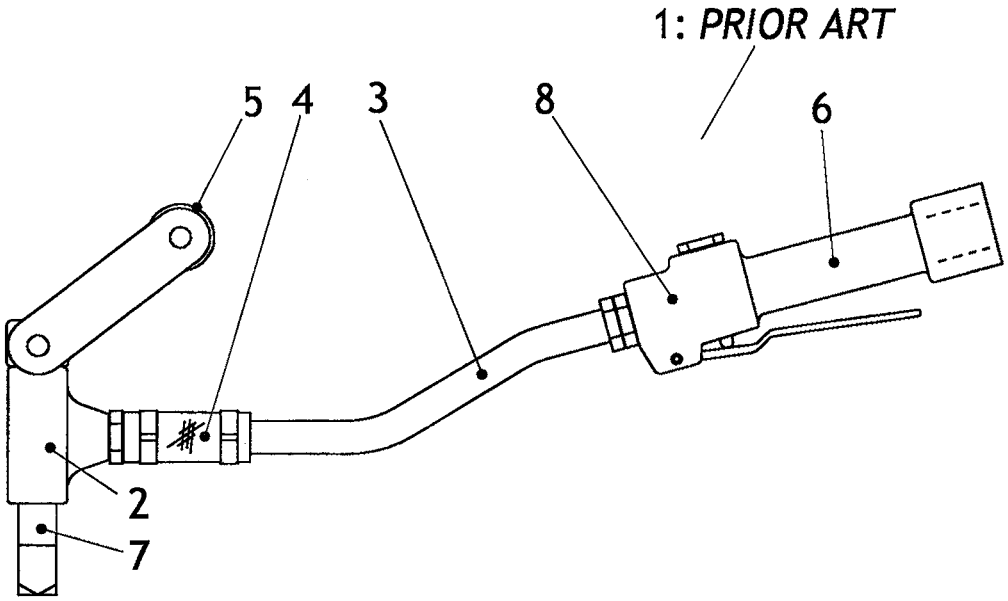

| | | | | | |
|---|---|---|---|---|---|
| 2,769,626 | A | * | 11/1956 | Becker | 299/41.1 |
| 3,225,443 | A | | 12/1965 | Young | |
| 3,366,420 | A | * | 1/1968 | Young | 299/37.4 |
| 3,589,352 | A | * | 6/1971 | Carlsson et al. | 125/6 |
| 3,675,973 | A | * | 7/1972 | Mottinger | 299/100 |
| 3,799,589 | A | * | 3/1974 | Boelkins | 285/281 |
| 3,837,230 | A | * | 9/1974 | Neuenberg | 74/47 |
| 3,904,245 | A | * | 9/1975 | Clarke | 299/37.4 |
| 4,027,647 | A | * | 6/1977 | Hoffman | 125/6 |
| 4,086,970 | A | | 5/1978 | Kato | |
| 4,225,187 | A | * | 9/1980 | Allan | 299/37.4 |
| 4,320,924 | A | * | 3/1982 | Langfield et al. | 299/37.4 |
| 4,349,231 | A | * | 9/1982 | Gut et al. | 299/69 |
| 4,371,043 | A | * | 2/1983 | Kubokawa | 173/162.2 |
| 4,451,093 | A | * | 5/1984 | Perez | 299/101 |
| 4,458,416 | A | * | 7/1984 | Hansson et al. | 30/168 |
| 4,487,592 | A | * | 12/1984 | Strader | 464/88 |
| 4,502,734 | A | * | 3/1985 | Allan | 299/101 |
| 4,527,728 | A | * | 7/1985 | Perez | 228/119 |
| 4,534,421 | A | * | 8/1985 | Allan | 173/130 |
| 4,594,759 | A | * | 6/1986 | Ikeda | 29/81.16 |
| 4,795,402 | A | * | 1/1989 | Reichardt | 464/74 |
| 4,840,409 | A | * | 6/1989 | Welkey | 285/146.3 |
| 4,841,842 | A | * | 6/1989 | Allan | 91/234 |
| 4,940,289 | A | * | 7/1990 | Trovato et al. | 299/37.4 |
| 4,947,532 | A | * | 8/1990 | Tucker | 29/81.14 |
| 4,997,050 | A | * | 3/1991 | Allan | 175/414 |
| 5,026,432 | A | * | 6/1991 | Johnson | 134/21 |
| 5,052,432 | A | * | 10/1991 | Vonalt et al. | 137/355.16 |
| 5,066,070 | A | * | 11/1991 | Clarke | 299/37.4 |
| 5,213,167 | A | * | 5/1993 | Best et al. | 173/162.2 |
| 5,322,131 | A | * | 6/1994 | Pressley et al. | 173/162.1 |
| 5,632,527 | A | * | 5/1997 | Halder | 299/100 |
| 5,788,576 | A | * | 8/1998 | Varin | 464/83 |
| 5,839,517 | A | * | 11/1998 | Gwinn et al. | 173/162.2 |
| 5,921,327 | A | * | 7/1999 | Henriksson et al. | 173/210 |
| 6,158,781 | A | * | 12/2000 | Aaron, III | 285/23 |
| 6,164,707 | A | * | 12/2000 | Ungchusri et al. | 285/276 |
| 6,755,260 | B1 | * | 6/2004 | Allan | 173/162.2 |
| 7,210,992 | B1 | * | 5/2007 | Wade et al | 451/344 |
| 7,357,195 | B2 | * | 4/2008 | Kamimura et al. | 173/216 |
| 7,610,968 | B1 | * | 11/2009 | Honsa | 173/211 |
| 8,522,894 | B2 | * | 9/2013 | Kraenzler et al. | 173/162.1 |
| 2002/0149255 | A1 | * | 10/2002 | Amherd | 299/64 |
| 2003/0104774 | A1 | * | 6/2003 | Peterson et al. | 451/351 |
| 2004/0231867 | A1 | * | 11/2004 | Becht et al. | 173/162.2 |
| 2005/0028995 | A1 | * | 2/2005 | Saito et al. | 173/176 |
| 2006/0196861 | A1 | * | 9/2006 | Denney et al. | 219/121.78 |
| 2006/0220381 | A1 | * | 10/2006 | Gill | 285/320 |
| 2006/0272130 | A1 | * | 12/2006 | Togami et al. | 16/431 |
| 2007/0107165 | A1 | * | 5/2007 | Oddo et al. | 16/431 |
| 2007/0163370 | A1 | * | 7/2007 | Berger et al. | 74/60 |
| 2008/0073095 | A1 | * | 3/2008 | Henriksson et al. | 173/162.2 |
| 2008/0185163 | A1 | * | 8/2008 | Becht et al. | 173/162.2 |
| 2008/0283261 | A1 | * | 11/2008 | Schmid et al. | 173/162.2 |
| 2009/0032276 | A1 | * | 2/2009 | Koch et al. | 173/131 |
| 2009/0065231 | A1 | | 3/2009 | Lu | |
| 2010/0038104 | A1 | * | 2/2010 | Baumann et al. | 173/162.1 |
| 2012/0055688 | A1 | * | 3/2012 | Gustafsson et al. | 173/162.2 |

FOREIGN PATENT DOCUMENTS

| | | | | | |
|---|---|---|---|---|---|
| CN | 202559756 | U | * | 11/2012 | E04G 21/02 |
| EP | 0375453 | A1 | | 6/1990 | |
| GB | 5663 | | | 0/1913 | |
| GB | EP 0074234 | | * | 8/1982 | B28D 1/265 |
| GB | EP 0074234 | | * | 3/1983 | B28D 1/28 |
| GR | 89100749 | A | | 4/1992 | |
| SE | 435694 | B | | 10/1984 | |
| SE | 506083 | C2 | | 11/1997 | |

* cited by examiner

HAND-HELD DEMOLITION TOOL

The invention concerns an air-powered hand-held demolition tool of the type known as "hand scabbler" (or "scaling hammer"). The tool is used for small-scale demolition work of concrete, brick, ceramic tiles, floor tiles and other similar hard materials. The tool can be used also to remove rust, welding slag, paint and other types of surface deposits on steel.

FIG. 1 shows a prior art hand-held demolition tool seen from the side. The prior art hand-held demolition tool 1 comprises a cylinder 2, a tube 3, a flexible coupling 4, a forward handle 5 and a rear handle 6. The operator uses the hands to hold the handles 5, 6 in order to maneuver and hold the tool in position during the demolition.

The cylinder 2 comprises three pistons 7, which are arranged in a vertically directed bore in the cylinder 2. The tool is often named a "three-head hand scabbler" for this reason. Also hand-held demolition tools with one, two or more pistons 7 are available. The pistons 7 have at the bottom tool bits that can be exchanged and they have internal valve arrangements that produce upwards and downwards movement of the pistons in the bore of the cylinder 2 when the operator supplies the cylinder 2 with pressurised air. It may be the case that the pistons 7 are provided with fixed tool bits.

The rear handle 6 extends longitudinally along the extension of the tube 3 and it is connected to a valve housing 8, which has at its rear an arrangement for the connection of a pressurised air line. The valve housing 8 comprises at its bottom a valve release, with which the operator regulates the supply of pressurised air. The pressurised air supplied is led through the internal channels of the rear handle 6 and the valve housing 8 forwards and onwards in the tube 3, which is connected to the forward part of the valve housing 8. The second end of the tube 3 is connected to the cylinder 2 through the flexible coupling 4.

During operation, the operator presses the hammer-action tool bits of the tool against the surface by applying a light vertical pressure onto the forward handle 5. The hammer-action tool bits impact the surface layer of the surface in the manner intended, while at the same time causes undesired vibratory movements of a complex nature of the cylinder 2. The vibratory movements principally contain alternating vertical movement and alternating torsion movement. The latter movements are produced as a consequence of the upwards and downwards movements of the three pistons not being synchronised, and as a consequence of the tool bits receiving reaction forces that are asymmetrically directed when impacting the surface.

The forward handle 5 has a direction of longitudinal extension that is oblique relative to the direction of longitudinal extension of the flexible coupling 4 (as illustrated in FIG. 1 of the drawing), or perpendicular thereto The forward handle is spaced at a distance from the rear handle 6 and the tube 3 is disposed between the forward and rear handles. The location and orientations of the handles 5, 6 create an overall solution for grip ergonomics that is ideal for this type of machine, and that is used also for other types of machine such as, for example, hammer drills, motor saws, etc.

The forward handle 5 has a vibration-damped connection with the cylinder 2 in order to absorb the vibratory movements and in this way protect the hand of the operator from vibration-induced damage. The forward handle 5 is arranged at the bottom of a U-shaped handle yoke. The two legs of the U-shaped handle yoke are attached at their ends in a manner that allows them to pivot to opposite sides of the upper part of the cylinder 2.

Figure 3A:
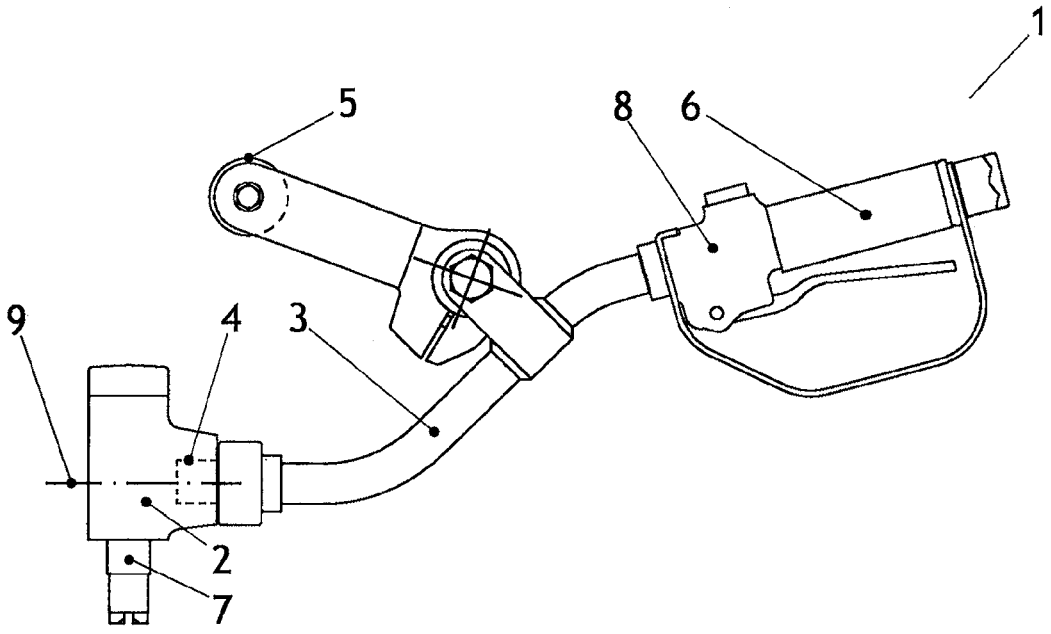
Figure 3B:
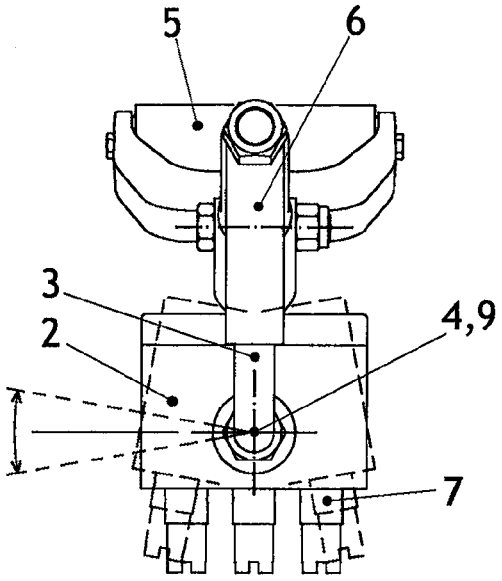

The pivot action of the connection of the two legs of the forward handle is damped and limited as a result of the legs being connected to elastic torsion elements disposed between the two connections. The pivot action of the forward handle is arranged around an axis that is oriented perpendicular to the direction of longitudinal extension of the flexible coupling 4. The U-shaped handle yoke is arranged such that Its legs form an oblique angle relative to the direction of movement of the pistons 7 (as illustrated by FIG. 3*b* of the drawing), and the conditions required for the elastic torsion elements to absorb not only vertical but also horizontal vibratory movement of a moderate amplitude are in this way created.

The vibratory movements that are produced during the operation of the tool 1, however, cannot be regarded as moderate, having as they do amplitudes that result in the majority of them passing the damping to an unacceptable degree and leading to risks for the health of the operator. Furthermore, the arrangement has no possibilities at all of absorbing torsional movements, and these are transferred in essentially undamped magnitude to the forward handle 5.

The rear handle 6 is insulated from the vibratory movements through the flexible coupling 4 comprising a short piece of rubber tube. The rubber tube absorbs the vibratory movements by allowing small oblique displacements and torsional movements between the cylinder 2 and the tube 3. The torsional movements are, however, transferred in essentially undamped magnitude to the rear handle 6, since the short tube offers a rigidly damping response to this movement.

A major disadvantage, furthermore, is that the rubber tube permits also large oblique displacements between the cylinder 2 and the tube 3 when the operator applies working pressure to the forward handle 5. This undesired property of the flexible coupling 4 causes problems in particular when the rubber tube has become soft or has become worn, after a certain period of use of the tool 1. One extreme consequence of the undesired property is that the oblique displacement becomes so large that the tube bends in such a manner as to prevent the supply of air to the cylinder 2, whereby the operation is halted. It is obvious that the operator will experience such a tool as unstable and difficult to operate.

The purpose of the present invention is, as specified in the patent claims, to provide a hand-held demolition tool in which the above-mentioned disadvantages are avoided. The flexible coupling has such a design that the operator experiences the tool as stable and easy to operate. The flexible coupling of the tool is also arranged such that it filters out the majority of the vibratory movements that are produced in the cylinder.

According to one embodiment, the forward handle of the tool is damped to vibration according to known principles, but connected to the tool in such a manner that it is not exposed to the vibratory movements that are filtered out by the flexible coupling. The vibration damping has, in this way, the conditions required for, and reduces in practice the level of, vibration in the forward handle to acceptable levels.

Figure 4:
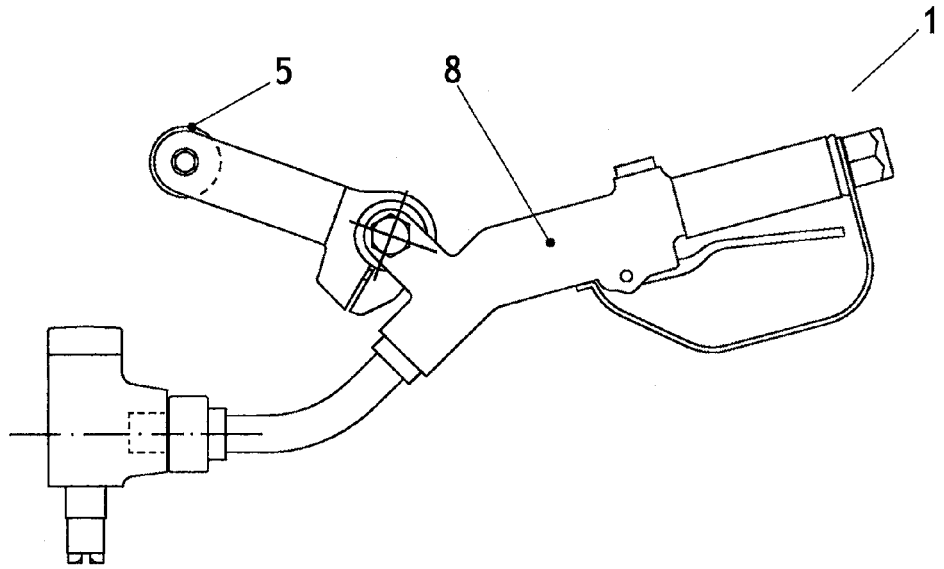
Figure 5:
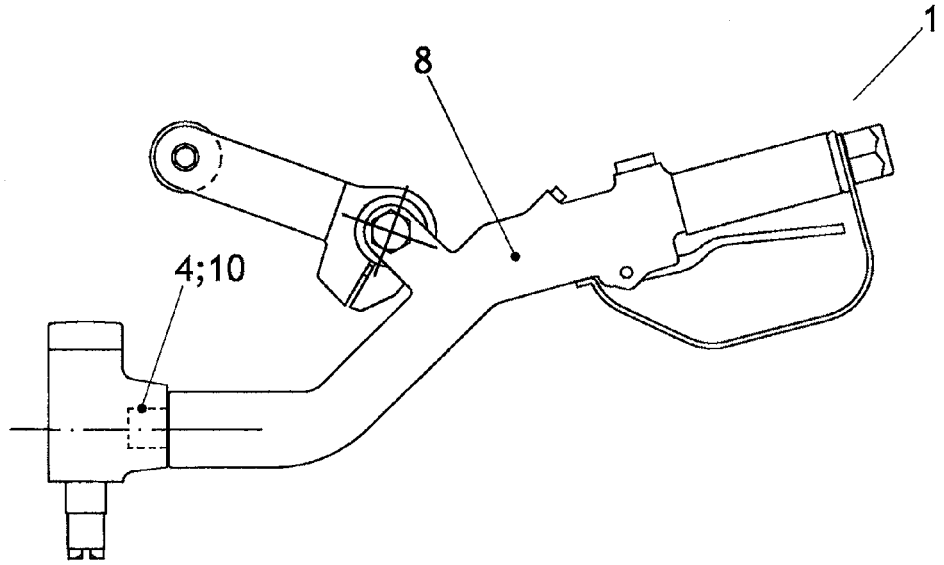

The invention will be described in more detail with the aid of the attached drawings, briefly described as follows. FIG. 1 illustrates a side view of a prior art hand-held demolition tool. FIGS. 2-5 and FIGS. 2*a*-2*c* show a hand-held demolition tool according to a first embodiment seen from the side, from the rear and in a sectioned view, and they show parts of the tool and its flexible coupling in a partially sectioned and enlarged view. FIGS. 3*a*-3*b* show, in the same manner, a hand-held demolition tool according to a second embodiment. FIG. 4 shows a third embodiment of the tool. FIG. 5 shows a fourth embodiment of the tool.

Figure 2A:
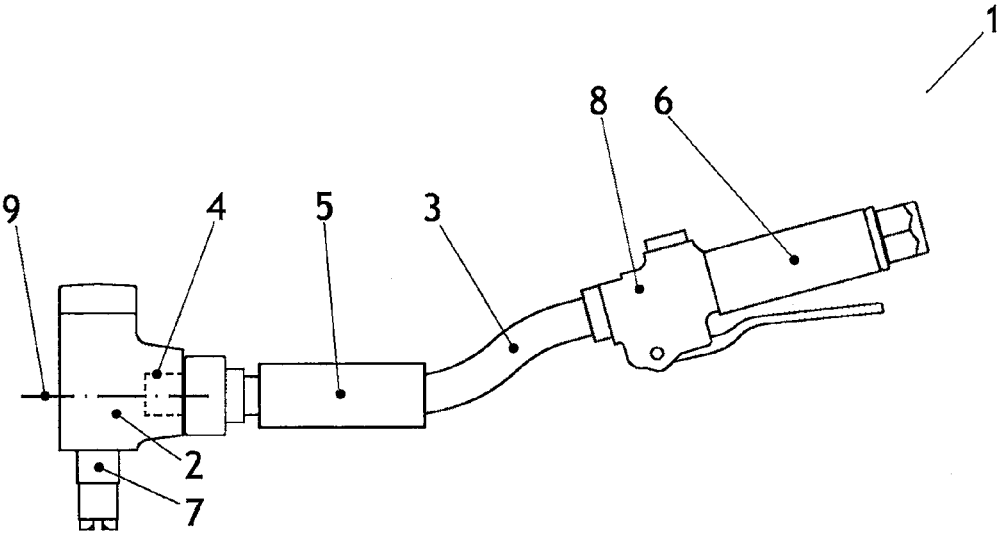
Figure 2B:
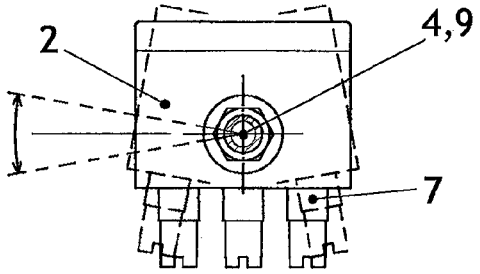
Figure 2C:
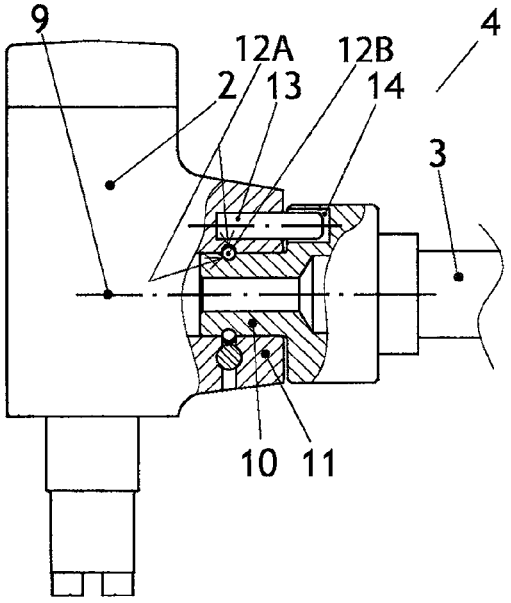

The hand-held demolition tool 1 in FIGS. 2*a*-2*c* has in principle the same design and function as the prior art tool shown in FIG. 1. The description below will concern the innovative improvements that ensure that the new tool 1 is suitable for its purpose. The hand-held demolition tool 1 in FIG. 2 comprises a cylinder 2 with three pistons 7, a tube 3, a flexible coupling 4, a valve housing 8, a forward handle 5 and a rear handle 6. The forward handle 5 is arranged between the cylinder 2 and the tube 3. The flexibility of the coupling 4 is arranged to be limited such that it allows flexibility only in the property of pivot action between the cylinder 2 and the forward handle 5 around a rigid theoretical axis 9.

The optimal arrangement is, as shown in FIG. 2*a*, that the direction of the axis 9 be perpendicular to the direction of up and down movement of the pistons 7, and that it coincide with the direction of longitudinal extension of the tube 3 immediately preceding its connection to the flexible coupling 4. The tube 3 is provided with external threads at both of its ends to enable its connection to the flexible coupling 4 and the valve housing 8. The threaded connections are locked with locking nuts in known manner.

The cylinder 2, as has been previously described, is caused to undertake undesired vibratory movements during operation of the tool 1. That part of the vibratory movements that consists of alternating torsional movements is efficiently absorbed by the arrangement, since these movements result only in the cylinder 2 performing small pivoting movements forwards and backwards around the theoretical axis 9 relative to the forward handle 5. It is preferable that the torsional movements around the axis 9 take place nearly free of friction and without any elastic influence. The latter condition is to prevent the occurrence of problems with self-oscillation. The flexible coupling 4 is designed such that it satisfies these requirements and will be described in detail in association with FIG. 2*c*.

FIGS. 3*a*-3*b* show a variant of the embodiment shown in FIGS. 2*a*-2*b* in which the cylinder 2 is directly connected to the tube 3, instead of being connected through the forward handle 5. The forward handle 5 is connected to the tube 3, but it can be connected to all other components of the tool 1. Both the forward handle 5 and the rear handle 6 are in this way insulated from that part of the vibratory movements that consists of alternating torsional movements. The forward handle 5 may, in principle, be connected to all other components of the tool 1 that are insulated from that part of the vibratory movements that consists of alternating torsional movements. Since the flexibility of the coupling 4 is limited such that it allows only torsional movements around the axis 9, the working pressure applied by the operator cannot cause the cylinder 2 and the tube 3 to take oblique positions.

Those parts of the vibrations that contain alternating vertical vibratory movements pass through the flexible coupling 4 undamped. The vertical movements place the complete tool 1 into an oscillatory movement around a point that is located approximately in the centre of the longitudinal extension of the rear handle 6. The amplitude of the alternating vertical movements decreases as one approaches this point.

Since the longitudinal extension of the rear handle 6 is located in the immediate vicinity of this point, the handle and the hand of the operator are subject to extremely small vertical vibratory movements. The rear handle 6 is externally clad with a soft material that is easy to grip and that damps the remaining vibrations to an acceptable level. The forward handle 5 has a connection that is damped for vibration and that is connected to the tube 3 at a position that is located on the half of the longitudinal extension of the tube 3 that is located more closely to the rear handle 6.

The absence of torsional movement and the low amplitude of the vertical vibratory movements at this ideal position provide the conditions required by the vibration-damping connection at the forward handle 5 and they reduce in reality the amplitude of vibration in the handle 5 to a low and acceptable level. It is also possible to connect the forward handle 5 with the tube 3 at a position that is located on the second half of the longitudinal extension of the tube 3. A higher amplitude of vibration of the handle 5 is obtained in this case, but the level of vibration is still acceptable.

The forward handle 5 is arranged between the two upper legs of a Y-shaped handle yoke of aluminium. The handle 5 comprises a tubular rigid sheath that is externally clad with a soft material that is easy to grip. The lower leg of the Y-shaped handle yoke is designed as a clamp with an internal recess for a vibration-damping bushing. The bushing is externally clamped in the recess and internally connected to the tube 3 through a U-shaped fixture and a screw connection. The bottom of the U-shaped fixture has internally the same diameter as the tube 3 and it is joined by welding to the tube 3 at the ideal position described above. The lower leg of the Y-shaped handle yoke comprises also a stop lug, arranged to contact the tube 3 when the operator applies too large a vertical working pressure at the forward handle 5.

Thus the vibration-damping bushing is protected from overload. The bushing is marketed by manufacturers of construction components and it has the same function and orientation as the elastic torsion elements that have been described in association with FIG. 1. It is preferable that the distribution of mass of the forward handle 5 be adapted, using known methods of optimisation, such that problems with self-oscillation are avoided during operation of the tool 1. It is appropriate that the optimisation be performed by influencing the mass of the tubular sheath of the handle 5.

FIGS. 2*b* and 3*b* show how the flexibility of the flexible coupling 4 is arranged to allow a range of pivot between the cylinder 2 and the tube 3, around a rigid theoretical axis 9. The pivoting range of the cylinder 2 (shown with dashed lines) relative to the tube 3 is arranged to be limited to approximately ±10° from an initial position of the cylinder 2. (These are shown with a curved arrow and with fully drawn lines, respectively, in the drawings.) The limitation of the range of pivot of the cylinder 2 ensures that the tool bits of the pistons 7 are always correctly oriented relative to the surface that is to be demolished using the hand-held demolition tool 1. The design of the limitation to the range of pivot will be shown in FIG. 2*c*.

FIG. 3*b* shows also how the forward handle 5 is arranged with a direction of longitudinal extension that is oblique relative to a vertical plane, coinciding with the direction of longitudinal extension of the rear handle 6. The forward handle 5 is arranged with a direction of longitudinal extension that is perpendicular to the vertical plane. The forward handle 5 is, as has been described previously, arranged between the two upper legs of the Y-shaped handle yoke. The yoke has the ability to pivot in a vibration-damped manner around a theoretical axis that is oriented perpendicular to the above-mentioned vertical plane (shown with a dot-dash line in the drawing).

The flexible coupling 4 in FIG. 2*c*, which can be used in any of the embodiments, comprises an axle spindle 10 with a circular cross-section and a swivel 11. The axle spindle 10 is arranged with its longitudinal extension along the rigid theoretical axis 9, and it has an internal channel to lead pressurised air to the cylinder 2.

The axle spindle 10 has an internal thread at one of its ends for the connection to, for example, the tube 3. The swivel 11 is arranged with play between it and the axle spindle 10. The swivel 11 is integrally arranged in the cylinder 2, although it is possible also to design it as an individual component with a threaded connection to the cylinder 2. It is possible also, in a similar manner, to instead integrate an axle spindle into the cylinder and arrange a swivel with connection for a tube.

The flexible coupling 4 comprises also a race 12A with associated steel balls 12B. The race 12A is arranged in an outer circumference of the axle spindle 10 and inside the surrounding swivel 11. The race 12A and the balls 12B make it possible to achieve the ability to pivot that is approximately free of friction between the axle spindle 10 and the swivel 11, and it has in principle the same function as the corresponding components in a ball bearing. The balls 12B pass through a channel to the race 12A when the swivel 11 is mounted on the axle spindle 10 and provide in this manner an axial lock between the components. The balls 12B are retained in the race 12A by a cylindrical pin that is arranged to block the channel. It is possible also to arrange the coupling without a race and steel balls, arranging in this case a plain bearing. The locking can then be arranged with a Seeger ring or other component with a similar function.

The flexible coupling 4 comprises also a locking pin 13 and a locking groove 14. The locking pin 13 is driven into a suitable hole in the swivel 11 and passes, with a small play, in and along the locking groove 14, which is arranged in the axle spindle 10. The locking groove 14 has a U-shaped cross-section and extends in length along an arc of a circle around the axis 9. The length of the locking groove is adapted such that it makes possible and limits the range of pivot between the cylinder 2 and, for example, the tube 3, as has been previously described. The limited range of pivot is obtained when the locking pin 13 makes contact with the walls at the ends of the locking groove 14.

It would be possible also to arrange the flexible coupling 4 at another location between the cylinder 2 and the rear handle 6, for example, between the tube 3 and the valve housing 8, or between the valve housing 8 and the rear handle 6. The latter location is the least advantageous, since it does not damp in the same manner the vibrations to the forward handle 5.

The U-shaped fixture for the forward handle 5 is an integral part of the valve housing 8 on the hand-held demolition tool 1 shown in FIG. 4. The function and design of the tool 1 are the same as those of the tool according to the embodiment shown in FIGS. 3*a-b*, with the exception of the function of the stop lug. This is arranged for contact with the valve housing 8 instead of the tube 3. It can therefore be said that the forward handle 5 is connected in this third embodiment to the valve housing 8 in a manner that damps vibrations.

The tube and its function have been integrated with the valve housing 8 in the fourth embodiment, shown in FIG. 5. The axle spindle 10 in the flexible coupling 4 is also an integral part of the valve housing 8. The function and design of the hand-held demolition tool 1 is otherwise the same as those of the tool according to the embodiment shown in FIG. 4.

The components that are parts of the hand-held demolition tool 1 can be manufactured from material that is used in prior art tools. The cylinder 2, the tube 3 and the flexible coupling 4, therefore, are manufactured from steel. The bearing surfaces of the flexible coupling 4 are case hardened. The valve housing 8 is manufactured from cast steel. It is fully possible to use other materials with similar properties, and other methods of optimising the bearing surfaces.

The invention is, naturally, not limited to the example described above: it can be modified within the scope of the attached patent claims.

The invention claimed is:

1. A hand-held pneumatic scabbler for demolition and resurfacing operations, said scabbler comprising a cylinder having at least one piston for receiving a tool bit for acting on a working surface; a forward and a rear handle to be held by an operator for maneuvering the scabbler during operation, said forward handle being arranged between the cylinder and said rear handle, said forward handle having a connection that is damped for vibration; a tube for supplying pressurized gas to said cylinder, one end of said tube being connected to the cylinder through a flexible coupling engaging the cylinder, the other end of said tube being coupled to a source of pressurized gas; wherein the flexible coupling is designed to allow only limited torsional movement of the cylinder, and the end of the tube connected to the cylinder, relative to the flexible coupling; said flexible coupling comprising: 1) an axle spindle arranged with its direction of longitudinal extension along a central axis extending through said flexible coupling, and a swivel arranged with play between it and the axle spindle, 2) a race with balls arranged to lock the swivel in an axial direction on the axle spindle and to make possible approximately friction-free pivot action between the axle spindle and the swivel, and 3) a locking pin and a corresponding locking groove, said locking pin and said locking groove being arranged to provide said limited torsional movement of the cylinder.

2. The hand scabbier according to claim 1, wherein the hand scabbier further comprises a valve housing between the cylinder and the rear handle, and the flexible coupling is arranged between the cylinder and the valve housing.

3. The hand scabbier according to claim 1, wherein the vibration-damped connection connects the forward handle with the tube.

4. The hand scabbier according to claim 3, wherein the vibration-damped connection is connected to the tube at a position that is located on that half of the longitudinal extension of the tube that lies most closely to the rear handle.

5. The hand scabbler according to claim 1, wherein the hand scabbler further comprises a valve housing between the cylinder and the rear handle, and the vibration-damped connection connects the forward handle with the valve housing.

6. The hand scabbler according to claim 1, wherein the forward handle has a longitudinal direction of extension coinciding with the central axis extending through said flexible coupling.

7. The hand scabbier according to claim 1, wherein said flexible coupling is arranged, at least in part, within said cylinder.

* * * * *